US006917772B2

(12) United States Patent
Hoshika

(10) Patent No.: US 6,917,772 B2
(45) Date of Patent: Jul. 12, 2005

(54) IMAGE FORMING APPARATUS FOR CONTROLLING DENSITY OF IMAGE, DETACHABLY ATTACHABLE DEVICE, AND MEMORY DEVICE

(75) Inventor: Norihisa Hoshika, Matsuyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 10/197,457

(22) Filed: Jul. 18, 2002

(65) Prior Publication Data

US 2003/0026623 A1 Feb. 6, 2003

(30) Foreign Application Priority Data

Jul. 23, 2001 (JP) ..... 2001/222313

(51) Int. Cl.[7] ..... G03G 15/08; G03G 15/00
(52) U.S. Cl. ..... 399/49; 399/119
(58) Field of Search ..... 399/49, 60, 53, 399/119

(56) References Cited

U.S. PATENT DOCUMENTS 6,181,885 B1 * 1/2001 Best et al. ..... 399/119
6,473,572 B1 * 10/2002 Uchiyama et al.

FOREIGN PATENT DOCUMENTS

| | | | | |
|---|---|---|---|---|
| CN | 97109608.2 | | 3/1997 | |
| EP | 1 074 892 A2 | | 2/2001 | |
| JP | 10186770 A | * | 7/1998 | ..... G03G/15/01 |
| JP | 11084855 A | * | 3/1999 | ..... G03G/15/08 |
| JP | 2001-125376 | | 5/2001 | |

* cited by examiner

*Primary Examiner*—Susan S. Y. Lee
(74) *Attorney, Agent, or Firm*—Fitzpatrick, Cella, Harper & Scinto

(57) ABSTRACT

An image forming apparatus to which a developing device is detachably attachable, wherein the developing device includes an element necessary for image formation and a memory, includes an image forming unit adapted to form an image; a controller adapted to set an image forming condition, such that a density of the image formed by the image forming unit is a desired density; a storage unit adapted to store in the memory, data regarding a density control result of the controller; a reading unit adapted to read the data stored in the memory; and a determination unit adapted to determine an interval of a density control by the controller based on the data read from the memory.

23 Claims, 8 Drawing Sheets

IMAGE FORMING APPARATUS FOR CONTROLLING DENSITY OF IMAGE, DETACHABLY ATTACHABLE DEVICE, AND MEMORY DEVICE

BACKGROUND OF THE INVENTION

1. Field of the Invention

The invention relates to an image forming apparatus such as a printer or a copying machine.

2. Description of Related Art

An image forming apparatus such as a printer or a copying machine is generally provided with density controlling means for automatically adjusting the density of an output image (e.g. a toner image) to a proper density. Particularly, in an image forming apparatus that outputs a toner image of four full colors, in order to obtain a desired color balance, more accurate density control is required of yellow, magenta, cyan and black toner images.

Density detection is effected, for example, by forming a toner image of a particular halftone pattern by area coverage modulation (hereinafter suitably referred to as a "patch image") on a photosensitive drum (image bearing member), and measuring the amount of reflected light of the halftone pattern on the photosensitive drum by a reflected light amount sensor comprising a light emitting element and a light receiving element. The density of the toner image can be controlled by image forming conditions such as the charging potential of the photosensitive drum, the exposure potential after laser exposure and development bias potential. So, one or a combination of a plurality of these image forming conditions is stepwisely changed to thereby form a plurality of halftone patterns, and the amount of reflected light thereof is measured by the reflected light amount sensor to thereby find image forming conditions under which it is presumed that desired constant density (amount of reflected light) can be obtained. As the reflected light amount sensor, use was made of one using infrared light and capable of estimating the amount of toner on the photosensitive drum irrespective of the color of the toner. The amount of infrared light received by the light receiving element of the reflected light amount sensor is substantially in inverse proportional to the amount of adhering toner, but the amount of adhering toner and the density of the output image are generally not in proportionality relation with each other. However, the amount of adhering toner and the density of the output image can be made to correspond to each other in a one-to-one relationship and therefore, the density of the toner image (output image) can be estimated from the measured value by the reflected light amount sensor.

This density control has a great effect in the stabilization of the dignity of image chiefly comprising a halftone such as a photographic image, and besides, to what degree the interval at which such density control is frequently effected depending on changes such as the fluctuation of the potential of the photosensitive drum, the fluctuation of the developing characteristic and the fluctuation of environment, namely, the time interval at which the density control is effected, is set becomes important.

That is, if the interval is set short and the density control is effected frequently, the dignity of image will be correspondingly stable. Conversely, however, to a user, image formation cannot be done during the density control and therefore, the time during the density control is not only a useless time, but the toner is uselessly consumed by forming a patch image and moreover, there is the demerit that waste toner is unnecessarily increased. If in contrast, the interval is set long, there will be the possibility that the especial density controlling mechanism cannot be used fully effectively and the dignity of image is reduced.

Therefore, heretofore, as an ordinary case, density control has been effected during the closing of the power supply switch of the main body of the image forming apparatus or each time a predetermined number of sheets of image formation is terminated, and as a special case, density control has been effected during the interchange of the photosensitive drum or a developing apparatus.

However, the fluctuation of the potential of the photosensitive drum, the fluctuation of the developing characteristic, the fluctuation of environment, etc. do not always change at a constant rate even if the interval is set to a constant one, and the fluctuation ranges are not constant. Thus, if as is usual, control is effected for each predetermined number of sheets, at one time it will become necessary to effect density control more frequently in order to keep the dignity of image, and at another time unnecessary density control will be effected although the dignity of image will not be reduced even if the interval is made longer. In such case, an increase in the user's waiting time or an increase in toner consumption and waste toner will result as previously described.

SUMMARY OF THE INVENTION

The present invention has been made in view of the above-noted circumstances and an object thereof is to provide an image forming apparatus in which the interval at which density control is executed is suitably set so as to prevent any reduction in the dignity of image, any increase in waiting time, any increase in toner consumption and waste toner, etc.

Another object of the present invention is to provide an image forming apparatus provided with control means for reading, prior to image formation, a plurality of toner images for density detection visualized with an image forming condition changed, by density detecting means, and setting an optimum image forming condition during image formation on the basis of the read density data, the image forming apparatus being provided with: developing means detachably mountable to the main body side of the image forming apparatus, the developing means having a non-volatile memory for storing therein at least a part of data about the image forming condition for controlling image density.

Still another object of the present invention is to provide a developing device for use in an image forming apparatus provided with control means for reading, prior to image formation, a plurality of toner images for density detection visualized with an image forming condition changed, by density detecting means, and setting an optimum image forming condition during image formation on the basis of the read density data, the developing device having a non-volatile memory for storing therein at least a part of data about the image forming condition for controlling image density, and being detachably mountable with respect to the main body side of the image forming apparatus.

Other objects, constructions and effects of the present invention will become apparent from the following detailed description and the accompanying drawings.

DESCRIPTION OF THE PREFERRED EMBODIMENTS

Some embodiments of the present invention will hereinafter be described with reference to the drawings.

Embodiment 1

Figure 1:
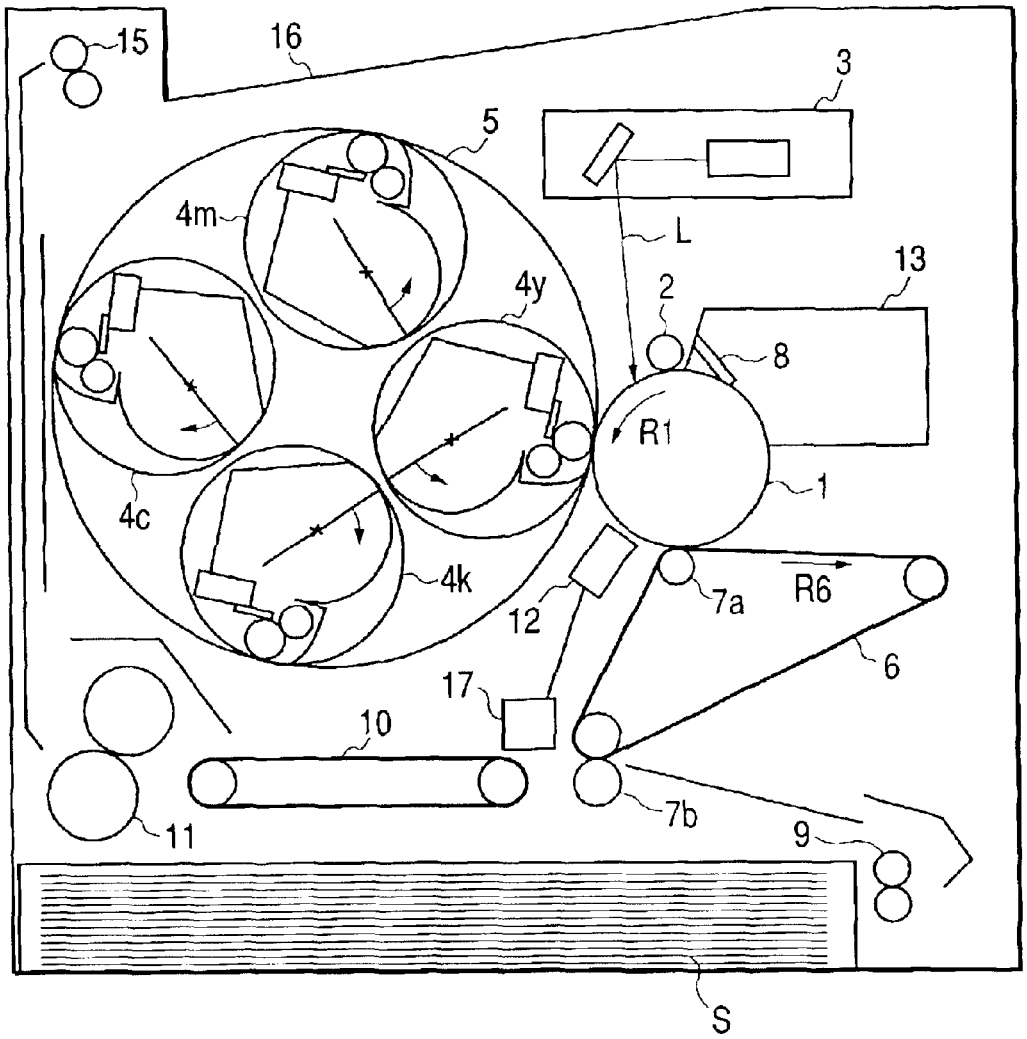
FIG. 1 is a longitudinal cross-sectional view schematically showing the construction of an image forming apparatus according to the present invention.

FIG. 1 shows an embodiment of an image forming apparatus according to the present invention. The image forming apparatus shown in FIG. 1 is a four-full-color laser printer of the electrophotographic type, and FIG. 1 is a longitudinal cross-sectional view schematically showing the construction thereof.

The image forming apparatus shown in FIG. 1 is provided with a drum-shaped electrophotographic photosensitive member (hereinafter referred to as the "photosensitive drum") 1 as an image bearing member.

The photosensitive drum 1 is driven in the direction indicated by the arrow R1 by driving means (not shown), and is uniformly charged to a predetermined polarity and potential by a charging roller (charging means) 2. Then, a laser beam L in accordance with a yellow image pattern is applied from an exposing device (laser scanner) 3 to the surface of the photosensitive drum 1, and an electrostatic latent image is formed on the photosensitive drum 1.

The electrostatic latent image formed on the photosensitive drum 1 is developed by a developing device (developing means) 4*y* containing a yellow toner therein and disposed in advance at a developing position opposed to the photosensitive drum 1, with the rotation of the photosensitive drum 1. Developing devices (developing means) 4*y*, 4*m*, 4*c* and 4*k* are supported by a rotary supporting member (rotary drum) 5, and prior to development, a developing device of a color used for development is rotatively moved to the position opposed to the drum.

A toner image visualized by development is primary-transferred onto an intermediate transfer belt (intermediate transfer member) 6 rotating in the direction indicated by the arrow R6 substantially at the same speed as the photosensitive drum 1, by a primary transfer bias applied to a primary transfer roller 7*a*. Any toner not transferred onto the intermediate transfer belt 6 but remaining on the photosensitive drum 1 (untransferred toner) is removed by a cleaning device 8.

A series of image forming processes, i.e., the above-described charging, exposing, development, primary transfer and cleaning, are also effected for each of magenta, cyan and black subsequently to yellow, and toner images of the respective colors are sequentially primary-transferred onto the intermediate transfer belt 6, and the toner images of the four colors are superimposed one upon another on the intermediate transfer belt 6.

The toner images of the four colors formed on the intermediate transfer belt 6 are secondary-transferred to a recording material S such as paper. The recording material S is supplied from a feed cassette to the secondary transfer portion between the intermediate transfer belt 6 and a secondary transfer roller 7*b* by feed rollers 9 in timed relationship with the toner images on the intermediate transfer belt 6. At this time, a secondary transfer bias is applied to the secondary transfer roller 7*b*, whereby the toner images of the four colors are collectively secondary-transferred onto the recording material S.

The recording material S after the transfer of the toner images of the four colors thereto is transported to a fixing device 11 by a transport belt 10, and is heated and pressurized there and the toner images are fusion-bonded and fixed on the surface thereof. After the fixing of the toner images, the recording material S is delivered onto a delivery tray 16 by delivery rollers 15. Thereby, a final color image is obtained on the surface of the recording material S.

In case of the use of the above-described image forming apparatus, as a matter of course, maintenance including the supply of the toners, the treatment of waste toners, the interchange of the consumed photosensitive drum 1, etc. becomes necessary. In the present embodiment, the photosensitive drum 1, the charging roller 2 and the cleaning device 8 are incorporated into a cartridge container (not shown) and made integral with one another to thereby constitute a process cartridge 13. Also, the developing devices 4*y*, 4*m*, 4*c* and 4*k* are individually made detachably mountable to the rotary supporting member 5. The process cartridge 13 and the developing devices (developing units) are adapted to be capable of being simply mounted and dismounted by the user himself without resort to a serviceman or the like.

In the present embodiment, in order to obtain desired color balance, design is made such that density control is effected for each of the yellow, magenta, cyan and black toner images.

Density detection is effected by forming a patch image of a particular halftone pattern by area coverage modulation on the photosensitive drum 1, and measuring the amount of reflected light of the patch image on the photosensitive drum by a reflected light amount sensor (density detecting means) 12 having a light emitting element and a light receiving element. The result of this measurement is sent to control means 17. The density of the toner image can be controlled by suitably adjusting the charged potential of the photosensitive drum 1 and the exposure potential after the laser exposure (latent image forming conditions) and image forming conditions such as development bias potential (developing condition). So, one or a combination of a plurality of these image forming conditions is stepwisely changed to thereby form a plurality of halftone patterns as a patch image, and the amount of reflected light thereof is measured by the reflected light amount sensor 12 to thereby find image forming conditions under which it is presumed that desired constant density (amount of reflected light) can be obtained. As the reflected light amount sensor 12, use is made of one using infrared light and capable of estimating the amount of toner on the photosensitive drum 1 irrespective of the color of the toner. The amount of infrared light received by the light receiving element of this reflected light amount sensor 12 is substantially in inverse proportional to the amount of adhering toner, but the amount of adhering toner and the density of the output image are generally not in proportionality relation with each other. However, the amount of adhering toner and the density of the output image can be made to correspond to each other in a one-to-one relationship and therefore, the density of the toner image (output image) can be estimated from the measured value by the reflected light amount sensor.

The density control in the above-described image forming apparatus will hereinafter be described in detail.

Figure 2:
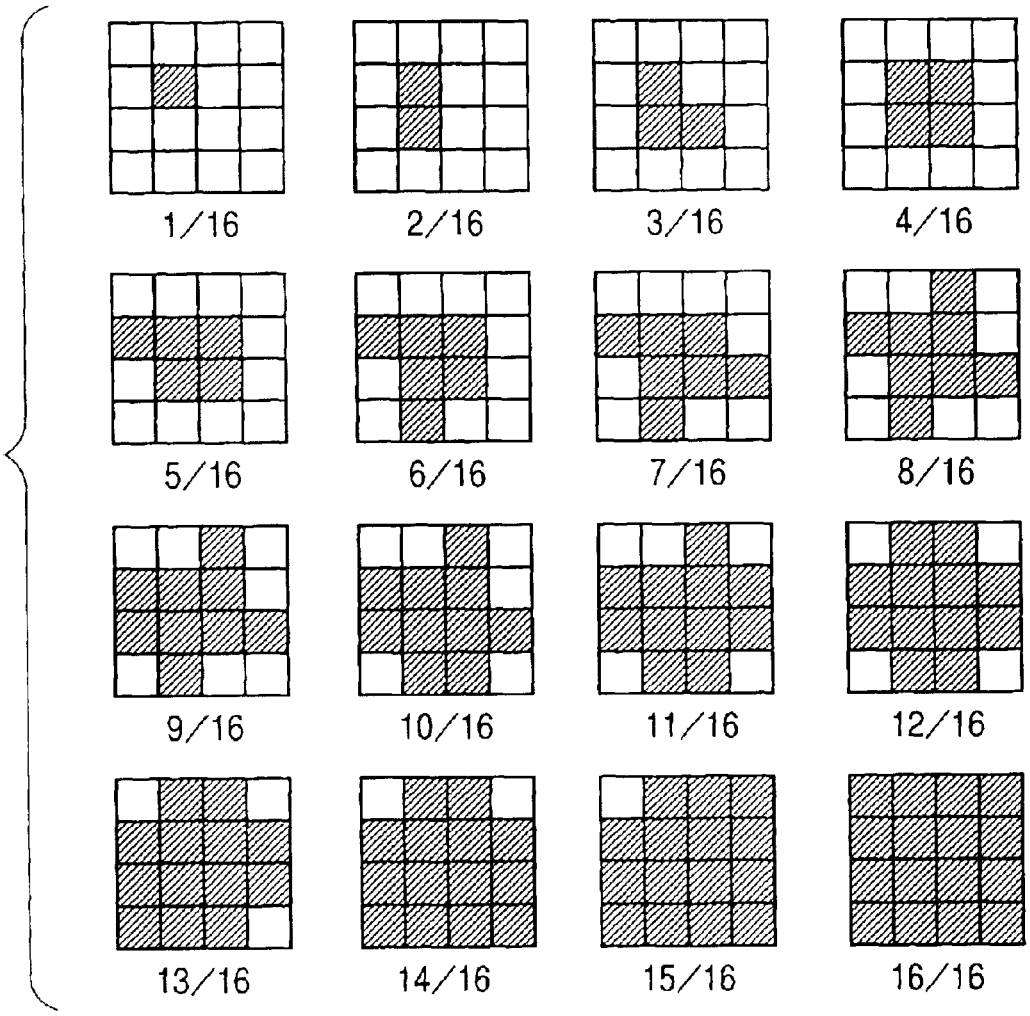
FIG. 2 shows halftone patterns for density measurement.
Figure 3:
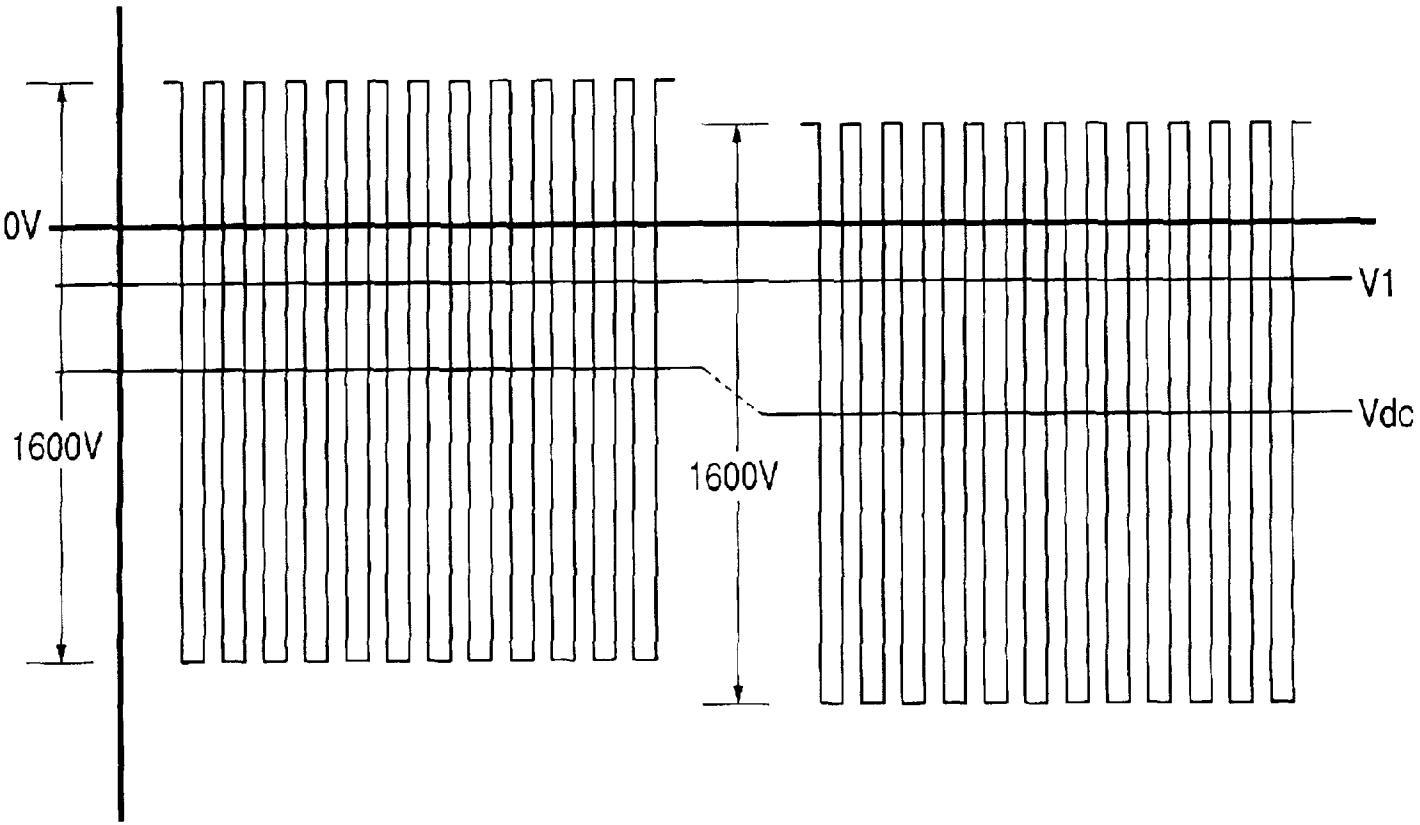
FIG. 3 shows a development bias applied to a developing device.

In the present embodiment, it is to be understood that the surface of the photosensitive drum 1 is charged so that the surface potential thereof may be −600 V, and the sensitivity of the photosensitive drum 1 and the exposure amount of the laser are adjusted so that the potential of the portion exposed to the laser beam may be nearly −200 V at normal temperature and normal humidity (23° C., 60% R.H.). Also, as the patch image (the toner image for density detection), of 4×4 dot matrix, use is made of a halftone pattern for printing 9 dots as shown in FIG. 2. Also, as the development bias, use is made of a rectangular wave (frequency 2,000 Hz, 1,600 Vpp) superimposed on a DC voltage, and the DC voltage component Vdc is made variable to thereby control the developing amount of the toner.

Figure 4:
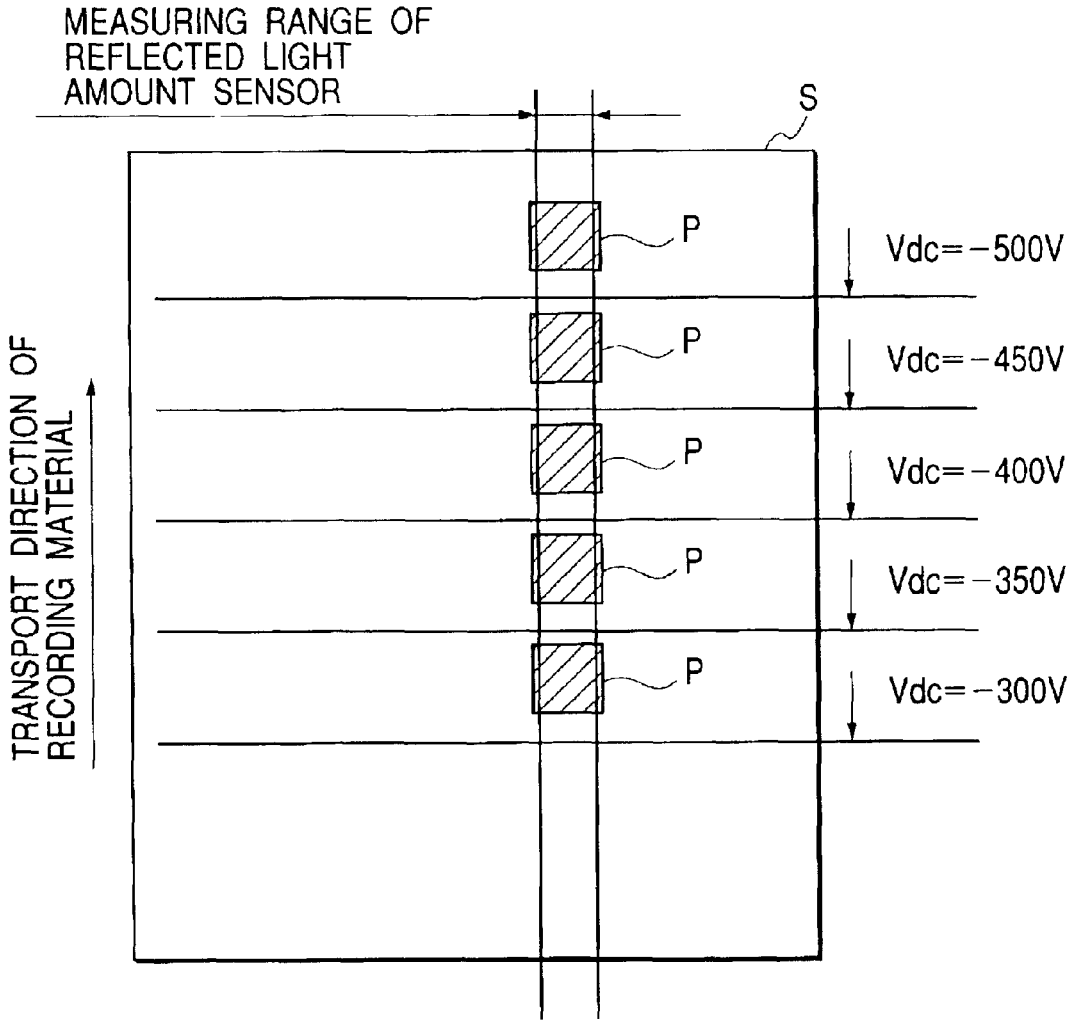
FIG. 4 shows an example of the halftone patterns for density measurement.

Prior to ordinary image formation, as shown in FIG. 4, a plurality of patch images P (toner images for density detection) of the above-described halftone pattern of 30 mm square are printed at predetermined intervals on a portion in which the reflected light amount sensor 12 is installed. The respective patch images P are developed by development biases of different DC voltage components Vdc, and with respect to each of them, the amount of reflected light is measured by the reflected light amount sensor 12. In the present embodiment, the number of the patch images P was five, and the DC component Vdc of the development bias was changed from −300 V to −500 V at intervals of 50 V.

Figure 5:
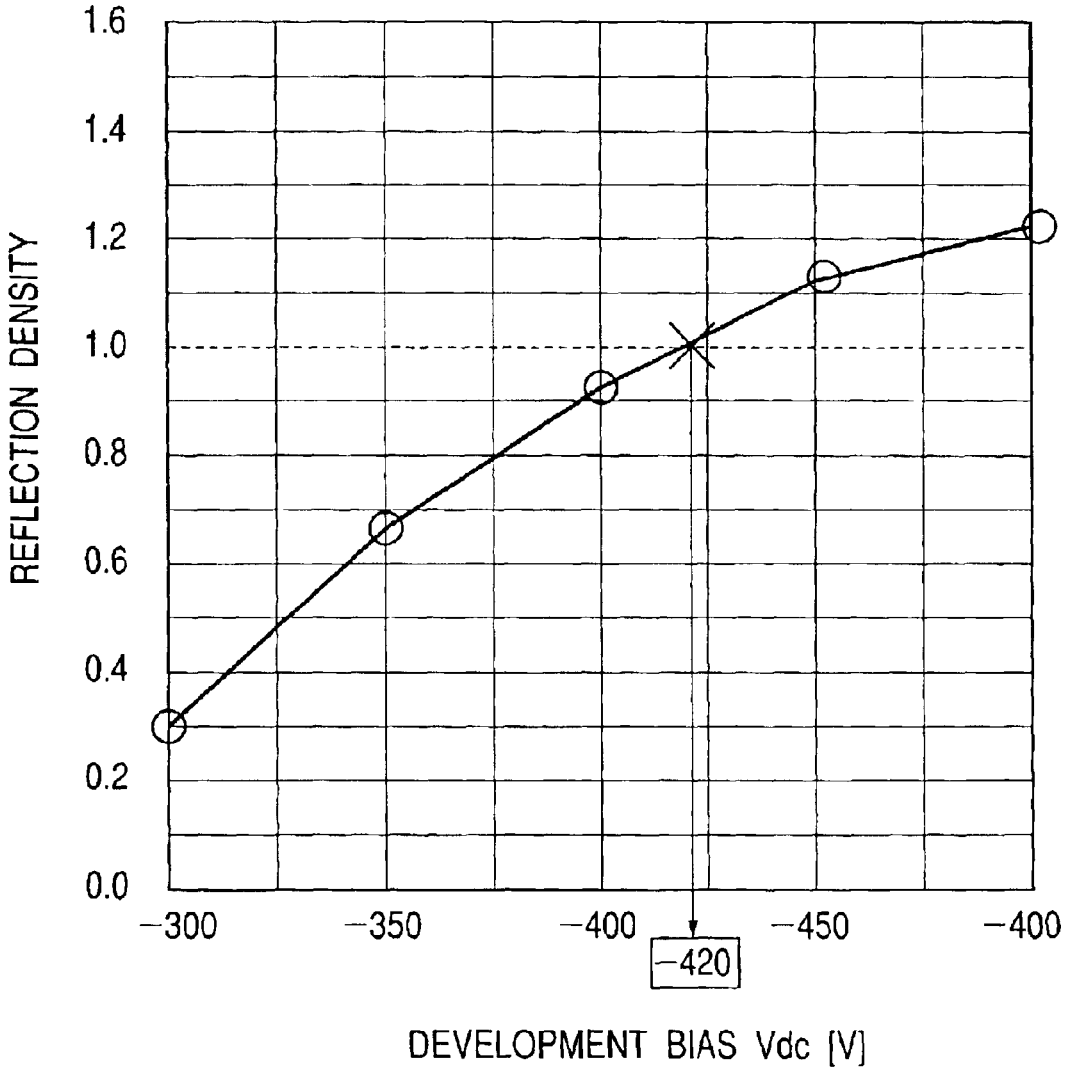
FIG. 5 is a graph showing the relation between a development bias for determining optimum image density and reflection density.

An example of the result of the measurement of the reflection density is shown in FIG. 5. In the present embodiment, the target value (proper density value) of the reflection density (density data) of the above-described halftone pattern is 1.0, and control is effected so that the image formation thereafter may be effected under a developing condition (in the present embodiment, the DC voltage component of the development bias) presumed to be most approximate thereto. In the present embodiment, there were obtained the reflection density data of five points indicated by white circle marks in FIG. 5. The developing condition under which the reflection density becomes 1.0 is such that the DC component Vdc is between −400 V and −450 V, and assuming that in this section, the DC component and the reflection density are approximately in proportionality relation with each other, it is presumed that the reflection density becomes 1.0 when the DC component is about −420 V as internally divided from the reflection densities for −400 V and −450 V. Consequently, in the present embodiment, as the image forming conditions thereafter, the DC component Vdc of the development bias is controlled to −420 V. While in the present embodiment, the number of the patch images P is five, the number can be increased and the intervals of the change in the development bias can be made five to thereby effect more accurate control.

The coverage rate of the halftone pattern may be changed to another one and another density target value may be given, but if the coverage rate is too high or too low, the linearity of the development bias and density which are density variable parameters becomes bad and thus, the control value hardly changes or conversely changes greatly and lacks stability. Therefore, the usually selected coverage rate of the halftone pattern is 50% to 80%.

The image forming conditions are in some cases greatly governed particularly by the fluctuation of the sensitivity of the photosensitive drum 1 (the fluctuation by temperature and humidity or the fluctuation of durability) and besides, may also be affected by the unevenness of the sensitivity or charging characteristic during the manufacture of the photosensitive drum 1 or the toners, the unevenness of the laser exposure amount of the exposing device 3, etc., but by the above-described density control being effected, these fluctuations can be absorbed to some extent and stable image formation can be effected.

When the factor of any one of the above-mentioned fluctuations is great and cannot be coped with by only the development bias, control can be effected by combining the charging condition or the exposing condition (exposure amount) or the like.

The present embodiment will hereinafter be described more specifically.

Figure 6:
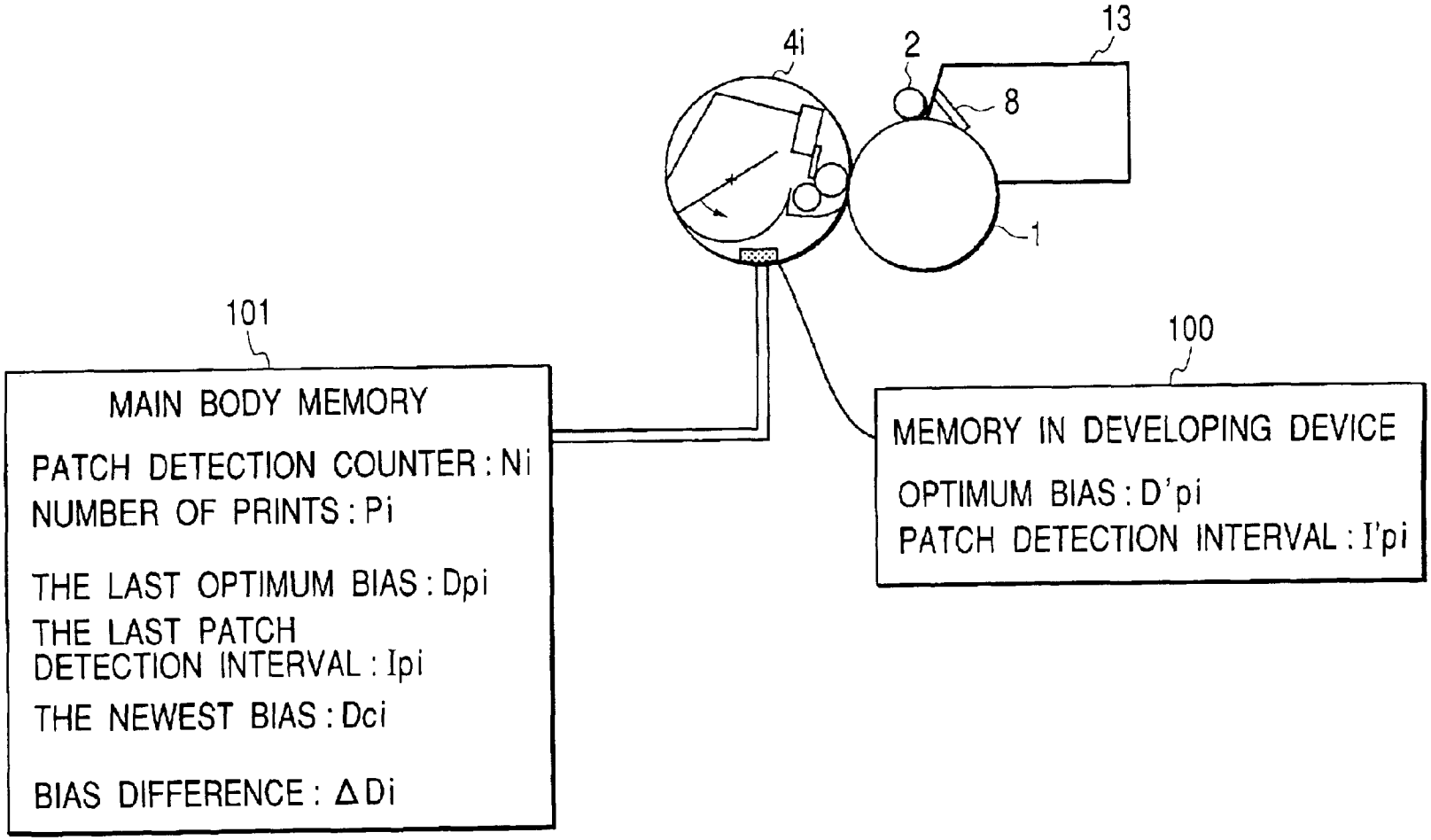
FIG. 6 illustrates a main body memory and a memory in the developing device.

FIG. 6 shows the developing device **4*i* in the image forming apparatus shown in FIG. 1, and a memory 100 provided in the developing device 4*i* (the suffix i represents color, and i=y, m, c, k) is connected to a main body memory 101 in the main body of the image forming apparatus. The memory 100** in the developing device is a non-volatile memory.

Various kinds of information are stored in the memory 100 in the developing device and the main body memory 101, but information having no relation with the present embodiment is omitted. In the memory 100 in the developing device, the optimum bias D'pi of the development bias and a patch detection interval I'pi are stored as information. Here, the suffix i represents color as described above, and there are four cases of i=y, m, c, k. That is, in the memory 100 in the yellow developing device **4*y*, there is stored the information of the optimum bias D'py of yellow and the patch detection interval I'py of yellow. In the memory 100 in the magenta developing device 4*m***, there is stored the information of the optimum bias D'pm for magenta and the patch detection interval I'pm for magenta. This also holds true of cyan and black which are the other two colors.

Also, the number of prints Pi is stored in the main body memory 101 when a print (image formation) command has come thereto. In the case of two sheets of full color prints and five sheets of monocolor prints Pm=2, Pc=2, Py=2 and Pk=7. That is, the number of black prints is two sheets of full color prints and five sheets of monocolor prints, thus seven sheets in total.

Also, the main body memory has a patch detection counter Ni, and has information as to for how many more sheets for each color the patch detection should be executed. It is in such a manner that if for example, Nc=85, patch detection for cyan is executed when 85 more sheets are taken for cyan.

The main body memory 101 also stores therein the newest bias (the newest development bias Dci which is a development bias being used at present and the last optimum bias (the last optimum development bias) Dpi which is a development bias used at the last time and the last patch detection interval Ipi which is information as to after how many sheets the next patch detection determined during the last patch detection should be executed. Each suffix i represents color, and i=y, m, c, k. Thus, the main body memory has each information for each color.

Also, the main body memory 101 has patch detection interval change threshold values A (the first predetermined value) and B (the second predetermined value) used for such changes as lengthening, not changing and shortening the patch detection interval. But A>B>0. The main body memory 101 also stores therein in advance a value C (>0) corresponding to the adjustment allowance when the patch detection interval is adjusted.

Figures 7, 7A:
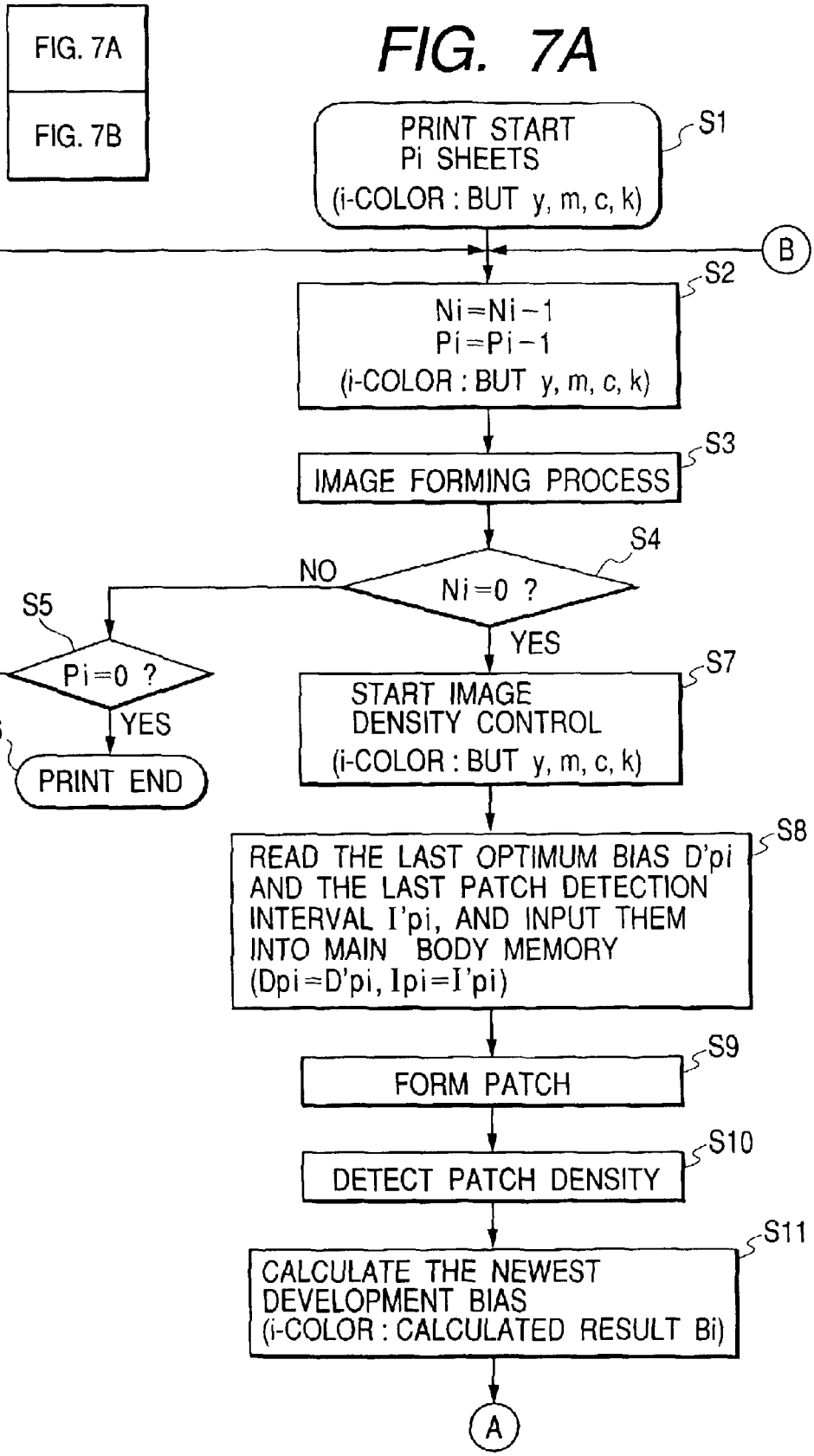
FIG. 7 is comprised of FIGS. 7A and 7B showing flowcharts of the flow of density control.
Figure 7B:
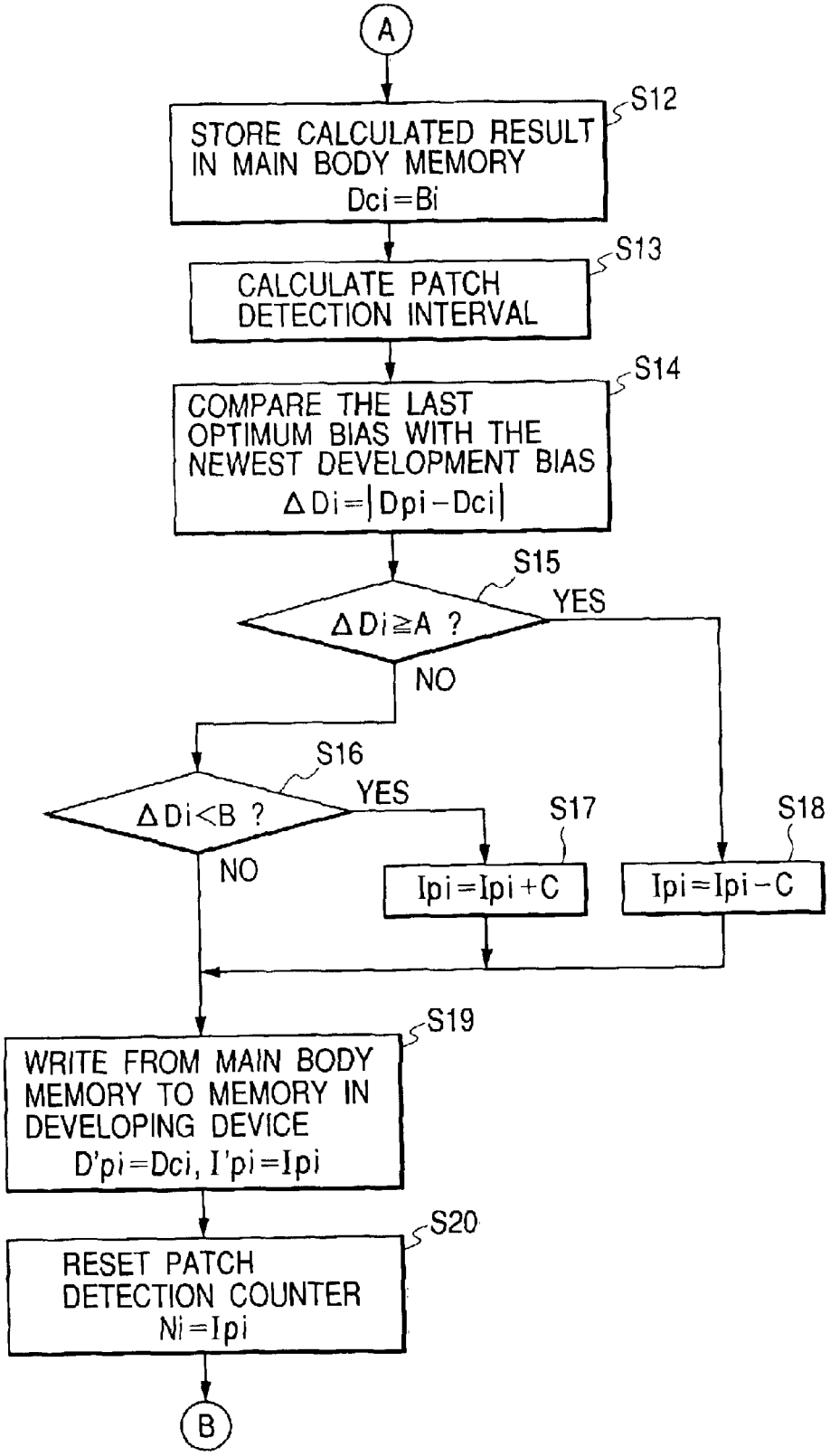

The present embodiment is embodied on the basis of the information in the memory 100 in the developing device and the main body memory 101 as described above. The flow of density control will hereinafter be described along the flowcharts of FIGS. 7A and 7B. S1, S2, . . . , S20 used in FIGS. 7A and 7B indicate the numbers of the procedures (steps).

Description will hereinafter be made in succession from S1.

S1:

First, a print signal is generated. At this time, the number of prints Pi is also indicated.

S2:

The patch detection counter Ni and the number of prints Pi are decreased by one (1) each.

S3:

Image formation of i color is started.

S4:

When the image formation has been ended, the value of the patch detection counter Ni is checked up. That is, if the value of the patch detection counter Ni is 0, it means that the timing for executing patch detection has come, and if the value of the patch detection counter Ni is other than 0, it means that it is still unnecessary to effect patch detection.

If the value of the patch detection counter Ni is not 0, advance is made to the next step S5. On the other hand, if the value of the patch detection counter Ni is 0, advance is made to a step S7, where patch detection (image density control) is carried out.

S5:

Since at the preceding step, it is not necessary to effect patch detection, whether there are left any number of prints is checked up. That is, if the number of prints Pi is 0, it is no longer necessary to print and therefore, advance is made to a step S6 which print ends. On the other hand, if the number of prints Pi is not 0, there are still left sheets to be printed and therefore, return is made to the step S2.

S6:

Print ends.

S7:

Image density control is started (patch detection is started).

S8:

The values of the last optimum bias D'pi and the last patch detection interval I'pi are read from the memory 100 in the developing device and are inputted into Dpi and Ipi of the main body memory 101. The values of the two are basically the same values, but when the developing device is interchanged, the value left in the main body memory 101 and the value in the memory 100 in the developing device may sometimes differ from each other. Even in such a case, prior to the control, the value stored in the memory 100 in the developing device can always be read to thereby cope with even the case of the interchange of the developing unit.

S9:

Patch is formed (the formation of a patch image).

S10

Patch density is detected (the density of the patch image is detected).

S11:

The calculation of the newest development bias is effected. The result calculated for i color is defined as Bi.

S12:

The calculated result Bi is written into Dci of the main body memory 101.

S13:

Next, the patch detection interval is calculated.

S14:

The bias difference (difference) ΔDi which is the absolute value of the difference between the last optimum bias Dpi and the newest development bias Dci is found.

S15:

Here, ΔDi is compared with a predetermined patch detection interval threshold value A.

In the present embodiment A=20 V (volts). That is, if the difference between the development bias chosen in the patch detection effected at the last time and the value chosen in the patch detection at this time is 20 V or greater, the fluctuation of the developing characteristic is great and therefore, advance is made to a step S18 to shorter the interval at which the patch detection is effected.

Also, if the aforementioned difference is less than 20 V, advance is made to a step S16 to judge whether the patch detection interval should be maintained as it is or the patch detection interval should be more extended because it is stable.

S16:

Here, ΔDi is compared with a predetermined patch detection interval threshold value B.

In the present embodiment, B=10 V (volts). That is, if the difference between the development bias chosen in the patch detection effected at the last time and the value chosen in the patch detection at this time is smaller than 10 V, the fluctuation of the developing characteristic is small and therefore, advance is made to a step S17 to lengthen the interval at which the patch detection is effected.

Also, if the aforementioned difference is 10 V or greater and 20 V or less, the last patch detection interval Ipi is not changed to maintain the patch detection interval as it is, and advance is made to a step S19.

S17:

Here, in order to extent the patch detection interval till the next time by C, the value of C is added to the last patch detection interval Ipi. In the case of the present embodiment, C=10 (images or sheets).

Assuming that the original patch detection interval was 50 sheets, if the fluctuation of the patch detection at this time is less than 10 V, the next patch detection is effected after 50 sheets+10 sheets=60 sheets.

S18:

Here, in order to shorten the patch detection interval till the next time by C, the value of C is subtracted from the last patch detection interval Ipi. In the case of the present embodiment C=10 (images or sheets).

Assuming that the original patch detection interval was 50 sheets, if the fluctuation of the patch detection at this time is greater than 20 V, the next patch detection is effected after 50 sheets−10 sheets=40 sheets.

S19:

Since the calculation of the patch detection interval has been ended, the newest bias Dci in the main body memory 101 and the recalculated last patch detection interval Ipi are written into D'pi and I'pi, respectively, in the memory 100 in the developing device.

S20:

The patch detection counter Ni is changed to the value Ipi of the patch detection interval after recalculated.

Thereafter, return is made to the step S2, where image formation is started again or print is ended.

As has hitherto been described, the value of the last patch detection and the value of the newest patch detection are compared with each other and when the difference therebetween is great, the patch detection interval is narrowed, and when the difference is between certain constant values, the patch detection interval is not changed, and when the difference is small, the patch detection interval is widened, whereby it becomes possible to output images at the minimum patch detection frequency for which the stability of the dignity of image is necessary. Also, the memory in the developing device has the information of the last patch detection therein, whereby even when the developing device has been interchanged, it has become possible to realize appropriate patch detection frequency.

While in the present embodiment, both of the increment and decrement of the patch detection frequency are the same value C, different values may be used as the increment and decrement. Also, instead of a fixed value, the value of the increment and decrement may be varied by the magnitude of the difference in the development bias. That is, the greater is the deviation, the more effective it is to suddenly shorten the patch detection interval.

As described above, according to the present invention, the developing means detachably mountable to the main body of the image forming apparatus has a non-volatile memory for storing therein at least a part of the data about the image forming conditions for controlling image density, whereby for example, the data about the optimum image forming conditions determined after the image density control and the data about the interval at which the image density control is executed are pre-stored in the memory, and in conformity with any change in the image forming conditions, the interval at which density detection is executed can be set suitably. Thereby, any reduction in the dignity of image, any increase in the waiting time, any increase in toner consumption and waste toner, etc. can be prevented. Also, even when the developing means has been interchanged, the interval at which density detection is executed can be set appropriately.

While the present invention has been described above with respect to some preferred embodiments, the present invention is not restricted to these embodiments, but it is apparent that various modifications and applications within the scope of the invention as defined in the appended claims.

What is claimed is:

1. An image forming apparatus to which a process device is detachably attachable, wherein the process device includes an element necessary for image formation and a memory, said image forming apparatus comprising:

an image forming unit adapted to form an image;

a controller adapted to set an image forming condition, such that a density of the image formed by said image forming unit is a desired density;

a storage unit adapted to store in the memory, data regarding a density control result of said controller;

a reading unit adapted to read the data stored in the memory; and a determination unit adapted to determine an interval of a density control by said controller based on the data read from the memory.

2. An image forming apparatus according to claim 1, wherein said storage unit adapted to further store, in the memory, data regarding a determined result of said determination unit.

3. An image forming apparatus according to claim 1, further comprising:

a detector adapted to detect a density of an image formed by said image forming unit, wherein said controller sets an image forming condition on the basis of a detection result of said detector, such that the density of the image formed by said image forming unit is the desired density.

4. An image forming apparatus according to claim 1, wherein said determination unit determines the interval of density control by said controller, by comparing a current density control result with a previous density control result.

5. An image forming apparatus according to claim 4, wherein said determination unit modifies the interval of density control when a difference between the current density control result and the previous density control result is greater than a predetermined value.

6. An image forming apparatus according to claim 5, wherein said determination unit shortens the interval of density control when the difference between the current density control result and the previous density control result is greater than a first predetermined value.

7. An image forming apparatus according to claim 6, wherein said determination unit lengthens the interval of density control when the difference between the current density control result and the previous density control result is smaller than a second predetermined value.

8. An image forming apparatus according to claim 1, wherein the process device is adapted to develop a latent image.

9. An image forming apparatus according to claim 1, wherein the interval of density control represents a number of image formations.

10. An image forming apparatus to which a process device is detachably attachable, wherein the process device includes an element necessary for image formation and a memory, said image forming apparatus comprising:

an image forming unit adapted to form an image;

a detector adapted to detect a density of an image formed by said image forming unit;

a controller adapted to set an image forming condition on the basis of a detection result of said detector, such that a density of the image formed by said image forming unit is a desired density;

a determination unit adapted to determine an interval of density control by said controller; and a storage unit adapted to store in the memory, data regarding the interval of density control.

11. An image forming apparatus according to claim 10, wherein said storage unit adapted to further store, in the memory, data regarding a determined result of said determination unit.

12. An image forming apparatus according to claim 10, wherein said determination unit determines the interval of density control by said controller, by comparing a current density control result with a previous density control result.

13. An image forming apparatus according to claim 12, wherein said determination unit modifies the interval of density control when a difference between the current density control result and the previous density control result is greater than a predetermined value.

14. An image forming apparatus according to claim 13, wherein said determination unit shortens the interval of density control when the difference between the current density control result and the previous density control result is greater than a first predetermined value.

15. An image forming apparatus according to claim 14, wherein said determination unit lengthens the interval of density control when the difference the current density control result and the previous density control result is smaller than a second predetermined value.

16. An image forming apparatus according to claim 10, wherein the process device is adapted to develop a latent image.

17. An image forming apparatus according to claim 10, wherein the interval of density control represents a number of image formations.

18. A process device which is detachably attachable to an image forming apparatus, wherein the image forming apparatus includes an image forming unit adapted to form an image, a detector adapted to detect a density of an image formed by the image forming unit, a controller adapted to set an image forming condition, such that a density of the image formed by the image forming unit is a desired density, and a determination unit adapted to determine an interval of density control by said controller, said process device comprising:

an element necessary for image formation; and a memory adapted to store data regarding an interval of a density control by the controller.

19. A process device according to claim 18, wherein said element is a developing device adapted to develop a latent image.

20. A process device according to claim 18, wherein the interval of density control represents a number of image formations.

21. A memory mounted to a process device, which is detachably attachable to an image forming apparatus, wherein the process device includes an element to form an image, and wherein the image forming apparatus includes:

an image forming unit adapted to form an image;

a detector adapted to detect a density of an image formed by said image forming unit;

a controller adapted to set an image forming condition, such that a density of the image formed by the image forming unit is a desired density; and a determination unit adapted to determine an interval of density control by said controller, wherein said memory stores data regarding an interval of density control by the controller based on a determination result of said determination unit.

22. A memory according to claim 21, wherein the element is adapted to develop a latent image.

23. A memory according to claim 21, wherein the interval of density control represents a number of image formations.

* * * * *

UNITED STATES PATENT AND TRADEMARK OFFICE

CERTIFICATE OF CORRECTION

PATENT NO. : 6,917,772 B2
DATED : July 12, 2005
INVENTOR(S) : Norhisa Hoshika et al.

It is certified that error appears in the above-identified patent and that said Letters Patent is hereby corrected as shown below:

Title page,
Item [30], Foreign Application Priority Data,
"Jul. 23, 2001 (JP) ……. 2001/222313" should read
-- Jul. 23, 2001 (JP) ……. 2001-222313 --.
Item [56], References Cited, U.S. PATENT DOCUMENTS, insert:
-- 2001-147633 5/2001 --.

Column 1,
Line 15, ""(e.g." should read -- (e.g., --;
Line 43, "proportional" should read -- proportion --; and
Line 45, "proportionality" should read -- proportional --.

Column 2,
Line 2, "especial" should read -- special --; and
Line 14, "etc." should read -- etc., --.

Column 4,
Line 19, "etc." should read -- etc., --;
Line 59, "proportional" should read -- proportion --; and
Line 62, "proportionality" should read -- proportional --.

Column 5,
Line 43, "proportionality" should read -- proportional --; and
Line 58, "becomes" should read -- become --.

Column 8,
Line 31, "extent" should read -- extend --.

Column 9,
Line 27, "etc." should read -- etc., --.

UNITED STATES PATENT AND TRADEMARK OFFICE

CERTIFICATE OF CORRECTION

PATENT NO. : 6,917,772 B2
DATED : July 12, 2005
INVENTOR(S) : Norhisa Hoshika et al.

It is certified that error appears in the above-identified patent and that said Letters Patent is hereby corrected as shown below:

Column 11,
Line 6, “difference the” should read -- difference between the --.

Signed and Sealed this

Twenty-eighth Day of February, 2006

JON W. DUDAS
*Director of the United States Patent and Trademark Office*